US008438019B2

(12) United States Patent
Vainio et al.

(10) Patent No.: US 8,438,019 B2
(45) **Date of Patent: *May 7, 2013**

(54) CLASSIFICATION OF AUDIO SIGNALS

(75) Inventors: Janne Vainio, Pirkkala (FI); Hannu Mikkola, Tampere (FI); Pasi Ojala, Kauniainen (FI); Jari Mäkinen, Tampere (FI)

(73) Assignee: Nokia Corporation, Espoo (FI)

( * ) Notice: Subject to any disclaimer, the term of this patent is extended or adjusted under 35 U.S.C. 154(b) by 1544 days.

This patent is subject to a terminal disclaimer.

(21) Appl. No.: 11/063,664

(22) Filed: Feb. 22, 2005

(65) Prior Publication Data

US 2005/0192798 A1 Sep. 1, 2005

(30) Foreign Application Priority Data

Feb. 23, 2004 (FI) ..... 20045051

(51) Int. Cl.
*G10L 19/12* (2006.01)
*G10L 21/00* (2006.01)

(52) U.S. Cl.
USPC ..... 704/223; 704/201

(58) Field of Classification Search ..... 704/219–223, 704/201
See application file for complete search history.

(56) References Cited

U.S. PATENT DOCUMENTS 5,737,484 A 4/1998 Ozawa
6,134,518 A * 10/2000 Cohen et al. ..... 704/201
6,311,154 B1 10/2001 Gersho et al.
6,640,208 B1 10/2003 Zhang et al.
2002/0062209 A1 5/2002 Choi
2003/0009325 A1 1/2003 Kirchherr et al.

FOREIGN PATENT DOCUMENTS

EP 1278184 1/2003

OTHER PUBLICATIONS

Bessette et al, "The adaptive multirate wideband speech codec (AMR-WB)," Speech and Audio Processing, IEEE Transactions on vol. 10, Issue 8, Nov. 2002 pp. 620-636.*
Erdal Paksoy, et al; "Variable Rate Speech Coding with Phonetic Segmentation;" IEEE; Apr. 1993; pp. 155-158.
"A wideband speech and audio codec at 16/24/32 kbit/s using hybrid ACELP/TCX techniques;" B. Besette et al; Speech Coding Proceedings, 1999 IEEE Workshop; Jun. 20-23, 1999; pp. 7-9.
B. Atal, et al.; "Advances in Speech Coding"; Kluwer Academic Publishers; 1991; whole document.

* cited by examiner

*Primary Examiner* — Angela A Armstrong
(74) *Attorney, Agent, or Firm* — Alston & Bird LLP

(57) ABSTRACT

An encoder comprising an input for inputting frames of an audio signal in a frequency band, at least a first excitation block for performing a first excitation for a speech like audio signal, and a second excitation block for performing a second excitation for a non-speech like audio signal. The encoder further comprises a filter for dividing the frequency band into a plurality of sub bands each having a narrower bandwidth than the frequency band. The encoder also comprises an excitation selection block for selecting one excitation block among the at least first excitation block and the second excitation block for performing the excitation for a frame of the audio signal on the basis of the properties of the audio signal at least at one of the sub bands. The invention also relates to a device, a system, a method and a storage medium for a computer program.

33 Claims, 7 Drawing Sheets

CLASSIFICATION OF AUDIO SIGNALS

CROSS-REFERENCE TO RELATED APPLICATIONS

This application claims priority under 35 USC §119 to Finnish Patent Application No. 20045051 filed on Feb. 23, 2004.

FIELD OF THE INVENTION

The invention relates to speech and audio coding in which the encoding mode is changed depending upon whether an input signal is a speech like or music like signal. The present invention relates to an encoder comprising an input for inputting frames of an audio signal in a frequency band, at least a first excitation block for performing a first excitation for a speech like audio signal, and a second excitation block for performing a second excitation for a non-speech like audio signal. The invention also relates to a device comprising an encoder comprising an input for inputting frames of an audio signal in a frequency band, at least a first excitation block for performing a first excitation for a speech like audio signal, and a second excitation block for performing a second excitation for a non-speech like audio signal. The invention also relates to a system comprising an encoder comprising an input for inputting frames of an audio signal in a frequency band, at least a first excitation block for performing a first excitation for a speech like audio signal, and a second excitation block for performing a second excitation for a non-speech like audio signal. The invention further relates to a method for compressing audio signals in a frequency band, in which a first excitation is used for a speech like audio signal, and second excitation is used for a non-speech like audio signal. The invention relates to a module for classifying frames of an audio signal in a frequency band for selection of an excitation among at least a first excitation for a speech like audio signal, and a second excitation for a non-speech like audio signal. The invention relates to a computer program product comprising machine executable steps for compressing audio signals in a frequency band, in which a first excitation is used for a speech like audio signal, and second excitation is used for a non-speech like audio signal.

BACKGROUND OF THE INVENTION

In many audio signal processing applications audio signals are compressed to reduce the processing power requirements when processing the audio signal. For example, in digital communication systems an audio signal is typically captured as an analogue signal, digitised in an analogue to digital (A/D) converter and then encoded before transmission over a wireless air interface between a user equipment, such as a mobile station, and a base station. The purpose of the encoding is to compress the digitised signal and transmit it over the air interface with the minimum amount of data whilst maintaining an acceptable signal quality level. This is particularly important as radio channel capacity over the wireless air interface is limited in a cellular communication network. There are also applications in which a digitised audio signal is stored to a storage medium for later reproduction of the audio signal.

The compression can be lossy or lossless. In lossy compression some information is lost during the compression wherein it is not possible to fully reconstruct the original signal from the compressed signal. In lossless compression no information is normally lost. Hence, the original signal can usually be completely reconstructed from the compressed signal.

The term audio signal is normally understood as a signal containing speech, music (non-speech) or both. The different nature of speech and music makes it rather difficult to design one compression algorithm which works enough well for both speech and music. Therefore, the problem is often solved by designing different algorithms for both audio and speech and use some kind of recognition method to recognise whether the audio signal is speech like or music like and select the appropriate algorithm according to the recognition.

In overall, classifying purely between speech and music or non-speech signals is a difficult task. The required accuracy depends heavily on the application. In some applications the accuracy is more critical like in speech recognition or in accurate archiving for storage and retrieval purposes. However, the situation is a bit different if the classification is used for selecting an optimal compression method for the input signal. In this case, it may happen that there does not exist one compression method that is always optimal for speech and another method that is always optimal for music or non-speech signals. In practise, it may be that a compression method for speech transients is also very efficient for music transients. It is also possible that a music compression for strong tonal components may be good for voiced speech segments. So, in these instances, methods for classifying just purely for speech and music do not create the most optimal algorithm to select the best compression method.

Often speech can be considered as bandlimited to between approximately 200 Hz and 3400 Hz. The typical sampling rate used by an A/D converter to convert an analogue speech signal into a digital signal is either 8 kHz or 16 kHz. Music or non-speech signals may contain frequency components well above the normal speech bandwidth. In some applications the audio system should be able to handle a frequency band between about 20 Hz to 20 000 kHz. The sample rate for that kind of signal should be at least 40 000 kHz to avoid aliasing. It should be noted here that the above mentioned values are just non-limiting examples. For example, in some systems the higher limit for music signals may be about 10 000 kHz or even less than that.

The sampled digital signal is then encoded, usually on a frame by frame basis, resulting in a digital data stream with a bit rate that is determined by a codec used for encoding. The higher the bit rate, the more data is encoded, which results in a more accurate representation of the input frame. The encoded audio signal can then be decoded and passed through a digital to analogue (D/A) converter to reconstruct a signal which is as near the original signal as possible.

An ideal codec will encode the audio signal with as few bits as possible thereby optimising channel capacity, while producing decoded audio signal that sounds as close to the original audio signal as possible. In practice there is usually a trade-off between the bit rate of the codec and the quality of the decoded audio.

At present there are numerous different codecs, such as the adaptive multi-rate (AMR) codec and the adaptive multi-rate wideband (AMR-WB) codec, which are developed for compressing and encoding audio signals. AMR was developed by the 3rd Generation Partnership Project (3GPP) for GSM/EDGE and WCDMA communication networks. In addition, it has also been envisaged that AMR will be used in packet switched networks. AMR is based on Algebraic Code Excited Linear Prediction (ACELP) coding. The AMR and AMR WB codecs consist of 8 and 9 active bit rates respectively and also include voice activity detection (VAD) and discontinuous transmission (DTX) functionality. At the moment, the sampling rate in the AMR codec is 8 kHz and in the AMR WB codec the sampling rate is 16 kHz. It is obvious that the codecs and sampling rates mentioned above are just non-limiting examples.

ACELP coding operates using a model of how the signal source is generated, and extracts from the signal the parameters of the model. MORE specifically, ACELP coding is based on a model of the human vocal system, where the throat and mouth are modelled as a linear filter and speech is generated by a periodic vibration of air exciting the filter. The speech is analysed on a frame by frame basis by the encoder and for each frame a set of parameters representing the modelled speech is generated and output by the encoder. The set of parameters may include excitation parameters and the coefficients for the filter as well as other parameters. The output from a speech encoder is often referred to as a parametric representation of the input speech signal. The set of parameters is then used by a suitably configured decoder to regenerate the input speech signal.

For some input signals, the pulse-like ACELP-excitation produces higher quality and for some input signals transform coded excitation (TCX) is more optimal. It is assumed here that ACELP-excitation is mostly used for typical speech content as an input signal and TCX-excitation is mostly used for typical music as an input signal. However, this is not always the case, i.e., sometimes speech signal has parts, which are music like and music signal has parts, which are speech like. The definition of speech like signal in this application is that most of the speech belongs to this category and some of the music may also belong to this category. For music like signals the definition is other way around. Additionally, there are some speech signal parts and music signal parts that are neutral in a sense that they can belong to the both classes.

The selection of excitation can be done in several ways: the most complex and quite good method is to encode both ACELP and TCX-excitation and then select the best excitation based on the synthesised speech signal. This analysis-by-synthesis type of method will provide good results but it is in some applications not practical because of its high complexity. In this method for example SNR-type of algorithm can be used to measure the quality produced by both excitations. This method can be called as a "brute-force" method because it tries all the combinations of different excitations and selects afterwards the best one. The less complex method would perform the synthesis only once by analysing the signal properties beforehand and then selecting the best excitation. The method can also be a combination of pre-selection and "brute-force" to make compromised between quality and complexity.

FIG. 1 presents a simplified encoder 100 with prior-art high complexity classification. An audio signal is input to the input signal block 101 in which the signal is digitised and filtered. The input signal block 101 also forms frames from the digitised and filtered signal. The frames are input to a linear prediction coding (LPC) analysis block 102. It performs a LPC analysis on the digitised input signal on a frame by frame basis to find such a parameter set which matches best with the input signal. The determined parameters (LPC parameters) are quantized and output 109 from the encoder 100. The encoder 100 also generates two output signals with LPC synthesis blocks 103, 104. The first LPC synthesis block 103 uses a signal generated by the TCX excitation block 105 to synthesise the audio signal for finding the code vector producing the best result for the TCX excitation. The second LPC synthesis block 104 uses a signal generated by the ACELP excitation block 106 to synthesise the audio signal for finding the code vector producing the best result for the ACELP excitation. In the excitation selection block 107 the signals generated by the LPC synthesis blocks 103, 104 are compared to determine which one of the excitation methods gives the best (optimal) excitation. Information about the selected excitation method and parameters of the selected excitation signal are, for example, quantized and channel coded 108 before outputting 109 the signals from the encoder 100 for transmission.

SUMMARY OF THE INVENTION

One aim of the present invention is to provide an improved method for classifying speech like and music like signals utilising frequency information of the signal. There are music like speech signal segments and vice versa and there are signal segments in speech and in music that can belong to either class. In other words, the invention does not purely classify between speech and music. However, it defines means for categorize input signal into music like and speech like components according to some criteria. The classification information can be used e.g. in a multimode encoder for selecting an encoding mode.

The invention is based on the idea that input signal is divided into several frequency bands and the relations between lower and higher frequency bands are analysed together with the energy level variations in those bands and the signal is classified into music like or speech like based on both of the calculated measurements or several different combinations of those measurements using different analysis windows and decision threshold values. This information can then be utilised for example in the selection of the compression method for the analysed signal.

The encoder according to the present invention is primarily characterised in that the encoder further comprises a filter for dividing the frequency band into a plurality of sub bands each having a narrower bandwidth than said frequency band, and an excitation selection block for selecting one excitation block among said at least first excitation block and said second excitation block for performing the excitation for a frame of the audio signal on the basis of the properties of the audio signal at least at one of said sub bands.

The device according to the present invention is primarily characterised in that said encoder comprises a filter for dividing the frequency band into a plurality of sub bands each having a narrower bandwidth than said frequency band, that the device also comprises an excitation selection block for selecting one excitation block among said at least first excitation block and said second excitation block for performing the excitation for a frame of the audio signal on the basis of the properties of the audio signal at least at one of said sub bands.

The system according to the present invention is primarily characterised in that said encoder further comprises a filter for dividing the frequency band into a plurality of sub bands each having a narrower bandwidth than said frequency band, that the system also comprises an excitation selection block for selecting one excitation block among said at least first excitation block and said second excitation block for performing the excitation for a frame of the audio signal on the basis of the properties of the audio signal at least at one of said sub bands.

The method according to the present invention is primarily characterised in that the frequency band is divided into a plurality of sub bands each having a narrower bandwidth than said frequency band, that one excitation among said at least first excitation and said second excitation is selected for performing the excitation for a frame of the audio signal on the basis of the properties of the audio signal at least at one of said sub bands.

The module according to the present invention is primarily characterised in that the module further comprises input for inputting information indicative of the frequency band divided into a plurality of sub bands each having a narrower bandwidth than said frequency band, and an excitation selection block for selecting one excitation block among said at least first excitation block and said second excitation block for performing the excitation for a frame of the audio signal on the basis of the properties of the audio signal at least at one of said sub bands.

The computer program product according to the present invention is primarily characterised in that the computer program product further comprises machine executable steps stored on a readable medium for execution by a processor, the machine executable steps for dividing the frequency band into a plurality of sub bands each having a narrower bandwidth than said frequency band, machine executable steps for selecting one excitation among said at least first excitation and said second excitation on the basis of the properties of the audio signal at least at one of said sub bands for performing the excitation for a frame of the audio signal.

In this application, terms "speech like" and "music like" are defined to separate the invention from the typical speech and music classifications. Even if around 90% of the speech were categorized as speech like in a system according to the present invention, the rest of the speech signal may be defined as a music like signal, which may improve audio quality if the selection of the compression algorithm is based on this classification. Also typical music signals may fall in 80-90% of the cases into music like signals but classifying part of the music signal into speech like category will improve the quality of the sound signal for the compression system. Therefore, the present invention provides advantages when compared with prior art methods and systems. By using the classification method according to the present invention it is possible to improve reproduced sound quality without greatly affecting the compression efficiency.

Compared to the brute-force approach presented above, the invention provides a much less complex pre-selection type approach to make selection between two excitation types. The invention divides input signal into frequency bands and analyses the relations between lower and higher frequency bands together and can also use, for example, the energy level variations in those bands and classifies the signal into music like or speech like.

DETAILED DESCRIPTION OF THE INVENTION

Figure 1:
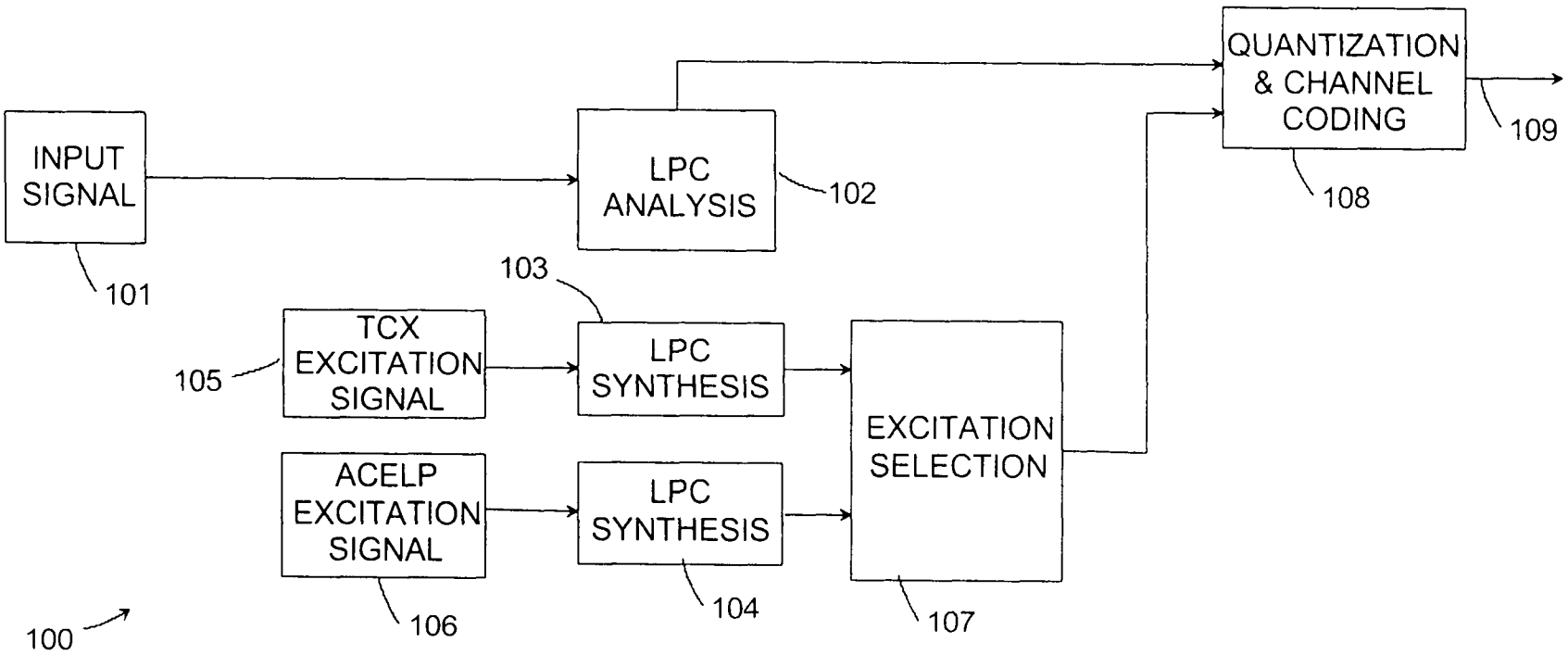
Fig. 1 PRIOR ART
FIG. 1 presents a simplified encoder with prior-art high complexity classification.
Figure 2:
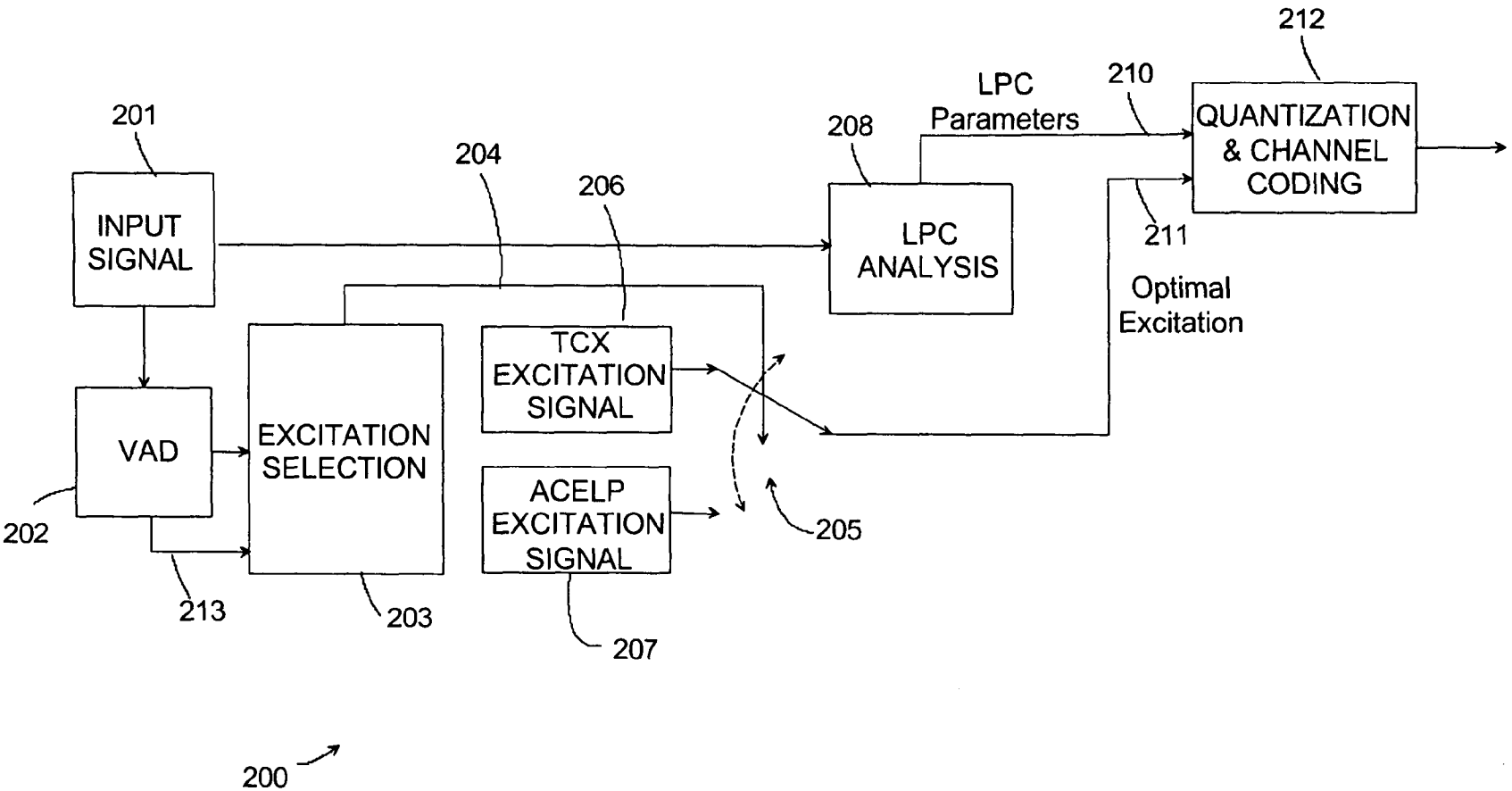
FIG. 2 presents an example embodiment of an encoder with classification according to the invention.

In the following an encoder 200 according to an example embodiment of the present invention will be described in more detail with reference to FIG. 2. The encoder 200 comprises an input block 201 for digitizing, filtering and framing the input signal when necessary. It should be noted here that the input signal may already be in a form suitable for the encoding process. For example, the input signal may have been digitised at an earlier stage and stored to a memory medium (not shown). The input signal frames are input to a voice activity detection block 202. The voice activity detection block 202 outputs a multiplicity of narrower band signals which are input to an excitation selection block 203. The excitation selection block 203 analyses the signals to determine which excitation method is the most appropriate one for encoding the input signal. The excitation selection block 203 produces a control signal 204 for controlling a selection means 205 according to the determination of the excitation method. If it was determined that the best excitation method for encoding the current frame of the input signal is a first excitation method, the selection means 205 are controlled to select the signal of a first excitation block 206. If it was determined that the best excitation method for encoding the current frame of the input signal is a second excitation method, the selection means 205 are controlled to select the signal of a second excitation block 207. Although the encoder of FIG. 2 has only the first 206 and the second excitation block 207 for the encoding process, it is obvious that there can also be more than two different excitation blocks for different excitation methods available in the encoder 200 to be used in the encoding of the input signal. The computer program product with its readable medium for storing machine executable steps and the associated processor for executing these steps can form part of the encoder 200, and may reside in the voice detection block 202 and the excitation selection block 223.

Figure 7:
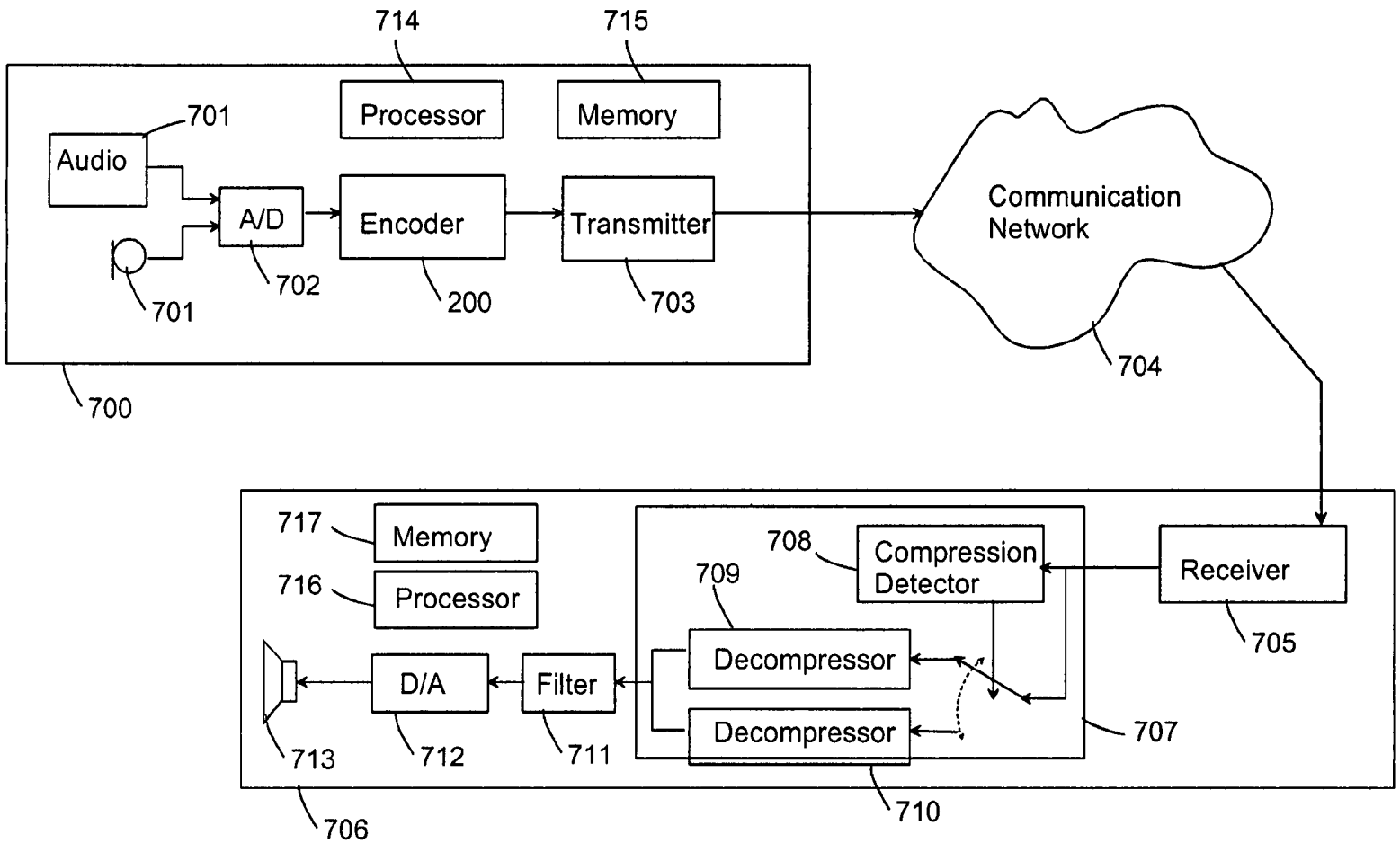
FIG. 7 shows an example of a system according to the present invention.

As also seen in FIG. 7, the machine executable steps of the computer program product may be stored e.g. on a memory 715 of the transmitting device 700 to be executed by a processor 714 of the transmitting device 700.

The receiving device 706 may also comprise a memory for storing machine executable steps of a computer program product and a processor 716 of the receiving device 706. Therefore, some of the operations of the receiving device 706 may also be implemented as a software product.

In some implementations there can be apparatuses in which both the operational blocks of the transmitting device 700 and the receiving device 706 are provided. The transmitting device 700 of such apparatuses can then transmit audio signals to be received and decoded by the receiving device 706 of another apparatus.

Referring again to FIG. 2, the first excitation block 206 produces, for example, a TCX excitation signal and the second excitation block 207 produces, for example, a ACELP excitation signal.

The LPC analysis block 208 performs a LPC analysis on the digitised input signal on a frame by frame basis to find such a parameter set which matches best with the input signal.

LPC parameters 210 and excitation parameters 211 are, for example, quantised and encoded in a quantisation and encoding block 212 before transmission e.g. to a communication network 704 (FIG. 7). However, it is not necessary to transmit the parameters but they can, for example, be stored on a storage medium and at a later stage retrieved for transmission and/or decoding.

Figure 3:
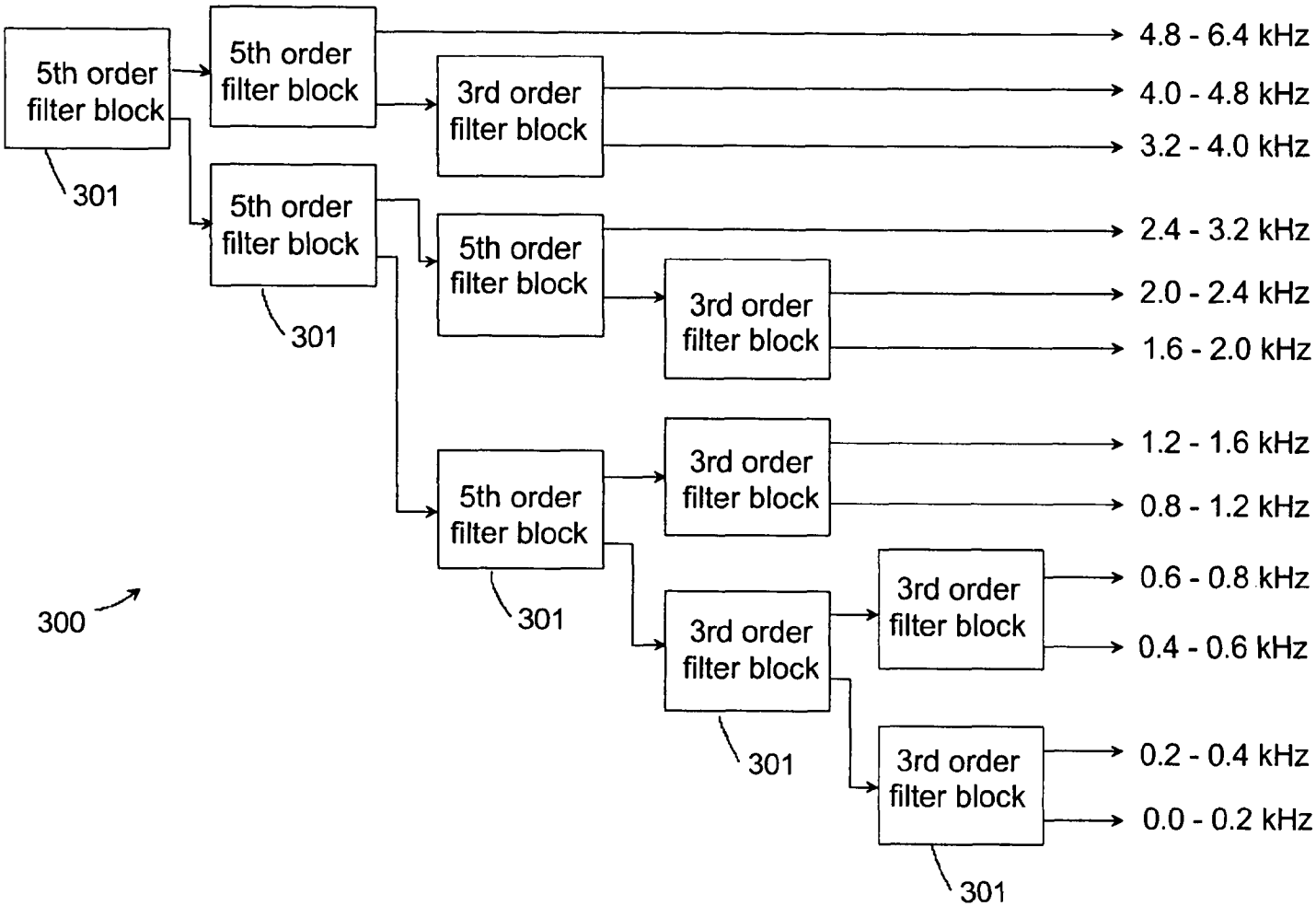
FIG. 3 illustrates an example of a VAD filter bank structure in AMR-WB VAD algorithm.

FIG. 3 depicts one example of a filter 300 which can be used in the encoder 200 for the signal analysis. The filter 300 is, for example, a filter bank of the voice activity detection block of the AMR-WB codec, wherein a separate filter is not needed but it is also possible to use other filters for this purpose. The filter 300 comprises two or more filter blocks 301 to divide the input signal into two or more subband signals on different frequencies. In other words, each output signal of the filter 300 represents a certain frequency band of the input signal. The output signals of the filter 300 can be used in the excitation selection block 203 to determine the frequency content of the input signal.

The excitation selection block 203 evaluates energy levels of each output of the filter bank 300 and analyses the relations between lower and higher frequency subbands together with the energy level variations in those subbands and classifies the signal into music like or speech like.

The invention is based on examining the frequency content of the input signal to select the excitation method for frames of the input signal. In the following, AMR-WB extension (AMR-WB+) is used as a practical example used to classify input signal into speech like or music like signals and to select either ACELP- or TCX-excitation for those signal respectively. However, the invention is not limited to AMR-WB codecs or ACELP- and TCX-excitation methods.

In the extended AMR-WB (AMR-WB+) codec, there are two types of excitation for LP-synthesis: ACELP pulse-like excitation and transform coded excitation (TCX). ACELP excitation is the same than used already in the original 3GPP AMR-WB standard (3GPP TS 26.190) and TCX is an improvement implemented in the extended AMR-WB.

AMR-WB extension example is based on the AMR-WB VAD filter banks, which for each 20 ms input frame, produces signal energy E(n) in the 12 subbands over the frequency range from 0 to 6400 Hz as shown in FIG. 3. The bandwidths of the filter banks are normally not equal but may vary on different bands as can be seen on FIG. 3. Also the number of subbands may vary and the subbands may be partly overlapping. Then energy levels of each subband are normalised by dividing the energy level E(n) from each subband by the width of that subband (in Hz) producing normalised EN(n) energy levels of each band where n is the band number from 0 to 11. Index 0 refers to the lowest subband shown in FIG. 3.

In the excitation selection block 203 the standard deviation of the energy levels is calculated for each of the 12 subbands using e.g. two windows: a short window stdshort(n) and a long window stdlong(n). For AMR-WB+case, the length of the short window is 4 frames and the long window is 16 frames. In these calculations, the 12 energy levels from the current frame together with past 3 or 15 frames are used to derive these two standard deviation values. The special feature of this calculation is that it is only performed when voice activity detection block 202 indicates 213 active speech. This will make the algorithm react faster especially after long speech pauses.

Then, for each frame, the average standard deviation over all the 12 filter banks are taken for both long and short window and average standard deviation values stdashort and stdalong are created.

For frames of the audio signal, also a relation between lower frequency bands and higher frequency bands are calculated. In AMR-WB+energy of lower frequency subbands LevL from 1 to 7 are taken and normalised by dividing it by the length (bandwidth) of these subbands (in Hz). For higher frequency bands from 8 to 11 energy of them are taken and normalised respectively to create LevH. Note that in this example embodiment the lowest subband 0 is not used in these calculations because it usually contains so much energy that it will distort the calculations and make the contributions from other subbands too small. From these measurements the relation LPH=LevL/LevH is defined. In addition, for each frame a moving average LPHa is calculated using the current and 3 past LPH values. After these calculations a measurement of the low and high frequency relation LPHaF for the current frame is calculated by using weighted sum of the current and 7 past moving average LPHa values by setting slightly more weighting for the latest values.

It is also possible to implement the present invention so that only one or few of the available subbands are analysed.

Also average level AVL of the filter blocks 301 for the current frame is calculated by subtracting the estimated level of background noise from each filter block output, and summing these levels multiplied by the highest frequency of the corresponding filter block 301, to balance the high frequency subbands containing relatively less energy than the lower frequency subbands.

Also the total energy of the current frame TotE0 from all the filter blocks 301 subtracted by background noise estimate of the each filter bank 301 is calculated.

After calculating these measurements, a choice between ACELP and TCX excitation is made by using, for example, the following method. In the following it is assumed that when a flag is set, other flags are cleared to prevent conflicts. First, the average standard deviation value for the long window stdalong is compared with a first threshold value TH1, for example 0.4. If the standard deviation value stdalong is smaller than the first threshold value TH1, a TCX MODE flag is set. Otherwise, the calculated measurement of the low and high frequency relation LPHaF is compared with a second threshold value TH2, for example 280.

If the calculated measurement of the low and high frequency relation LPHaF is greater than the second threshold value TH2, the TCX MODE flag is set. Otherwise, an inverse of the standard deviation value stdalong subtracted by the first threshold value TH1 is calculated and a first constant C1, for example 5, is summed to the calculated inverse value. The sum is compared with the calculated measurement of the low and high frequency relation LPHaF:

$$C1+(1/(stda\text{long}-TH1))>LPHaF \quad (1)$$

If the result of the comparison is true, the TCX MODE flag is set. If the result of the comparison is not true, the standard deviation value stdalong is multiplied by a first multiplicand M1 (e.g. −90) and a second constant C2 (e.g. 120) is added to the result of the multiplication. The sum is compared with the calculated measurement of the low and high frequency relation LPHaF:

$$M1*stda\text{long}+C2<LPHaF \quad (2)$$

If the sum is smaller than the calculated measurement of the low and high frequency relation LPHaF, an ACELP MODE flag is set. Otherwise an UNCERTAIN MODE flag is set indicating that the excitation method could not yet be selected for the current frame.

A further examination is performed after the above described steps before the excitation method for the current frame is selected. First, it is examined whether either the ACELP MODE flag or the UNCERTAIN MODE flag is set and if the calculated average level AVL of the filter banks 301 for the current frame is greater than a third threshold value TH3 (e.g. 2000), therein the TCX MODE flag is set and the ACELP MODE flag and the UNCERTAIN MODE flag are cleared.

Next, if the UNCERTAIN MODE flag is set, the similar evaluations are performed for the average standard deviation value stdashort for the short window than what was performed above for the average standard deviation value stdalong for the long window but using slightly different values for the constants and thresholds in the comparisons. If the average standard deviation value stdashort for the short window is smaller than a fourth threshold value TH4 (e.g. 0.2), the TCX MODE flag is set. Otherwise, an inverse of the standard deviation value stdashort for the short window subtracted by the fourth threshold value TH4 is calculated and a third constant C3 (e.g. 2.5) is summed to the calculated inverse value. The sum is compared with the calculated measurement of the low and high frequency relation LPHaF:

$$C3+(1/(stdashort-TH4))>LPHaF \quad (3)$$

If the result of the comparison is true, the TCX MODE flag is set. If the result of the comparison is not true, the standard deviation value stdashort is multiplied by a second multiplicand M2 (e.g. −90) and a fourth constant C4 (e.g. 140) is added to the result of the multiplication. The sum is compared with the calculated measurement of the low and high frequency relation LPHaF:

$$M2*stdashort+C4<LPHaF \quad (4)$$

If the sum is smaller than the calculated measurement of the low and high frequency relation LPHaF, the ACELP MODE flag is set. Otherwise the UNCERTAIN MODE flag is set indicating that the excitation method could not yet be selected for the current frame.

At the next stage the energy levels of the current frame and the previous frame are examined. If the rate between the total energy of the current frame TotE0 and the total energy of the previous frame TotE-1 is greater than a fifth threshold value TH5 (e.g. 25) the ACELP MODE flag is set and the TCX MODE flag and the UNCERTAIN MODE flag are cleared.

Finally, if the TCX MODE flag or the UNCERTAIN MODE flag is set and if the calculated average level AVL of the filter banks 301 for the current frame is greater than the third threshold value TH3 and the total energy of the current frame TotE0 is less than a sixth threshold value TH6 (e.g. 60) the ACELP MODE flag is set.

When the above described evaluation method is performed the first excitation method and the first excitation block 206 is selected if the TCX MODE flag is set or the second excitation method and the second excitation block 207 is selected if the ACELP MODE flag is set. If, however, the UNCERTAIN MODE flag is set, the evaluation method could not perform the selection. In that case e either ACELP or TCX is selected or some further analysis have to be performed to make the differentiation.

The method can also be illustrated as the following pseudo-code:

```
if (stdalong < TH1)
    SET TCX_MODE
else if (LPHaF > TH2)
    SET TCX_MODE
else if ((C1+(1/( stdalong −TH1))) > LPHaF)
        SET TCX_MODE
    else if ((M1* stdalong +C2) < LPHaF)
        SET ACELP_MODE
```

-continued

```
    else
        SET UNCERTAIN_MODE
if (ACELP_MODE or UNCERTAIN_MODE) and (AVL > TH3)
    SET TCX_MODE
if (UNCERTAIN_MODE)
    if (stdashort < TH4)
        SET TCX_MODE
    else    if ((C3+(1/( stdashort −TH4))) > LPHaF)
            SET TCX_MODE
        else if ((M2* stdashort+C4) < LPHaF)
            SET ACELP_MODE
        else
            SET UNCERTAIN_MODE
if (UNCERTAIN_MODE)
    if ((TotE0 / TotE−1)>TH5)
        SET ACELP_MODE
if (TCX_MODE || UNCERTAIN_MODE))
    if (AVL > TH3 and TotE0 < TH6)
        SET ACELP_MODE
```

Figure 4:
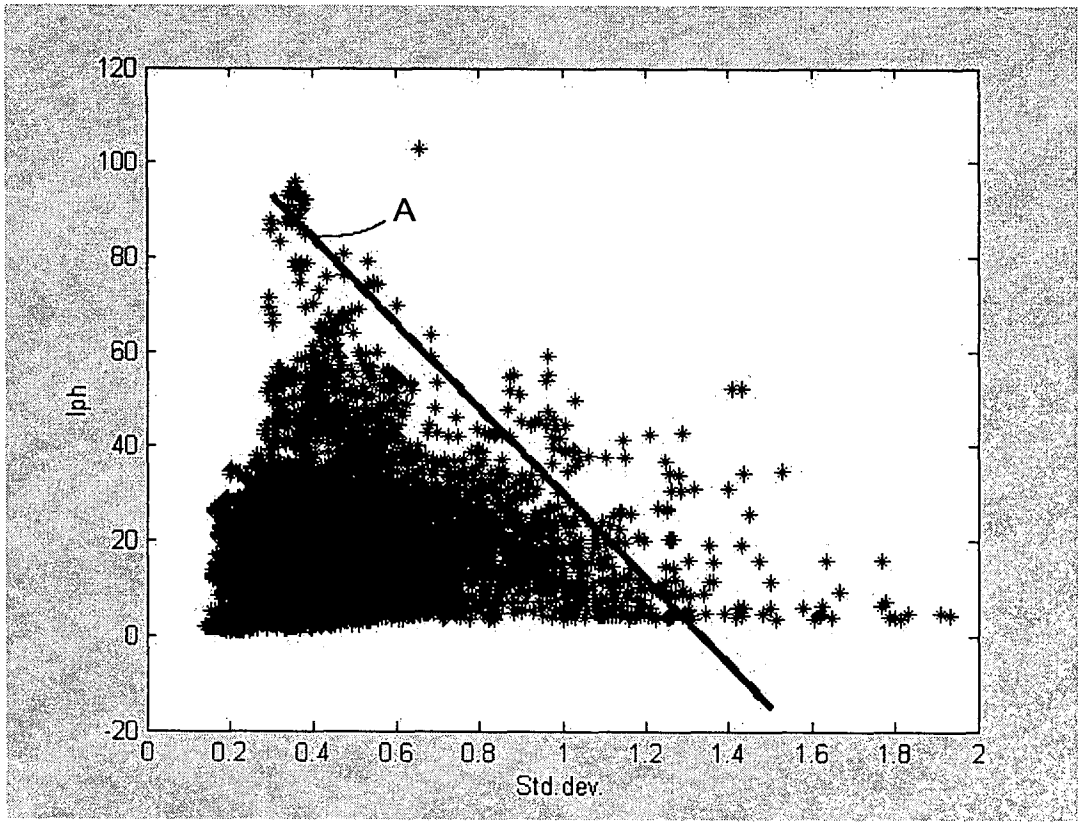
FIG. 4 shows an example of a plotting of standard deviation of energy levels in VAD filter banks as a function of the relation between low and high-energy components in a music signal.
Figure 5:
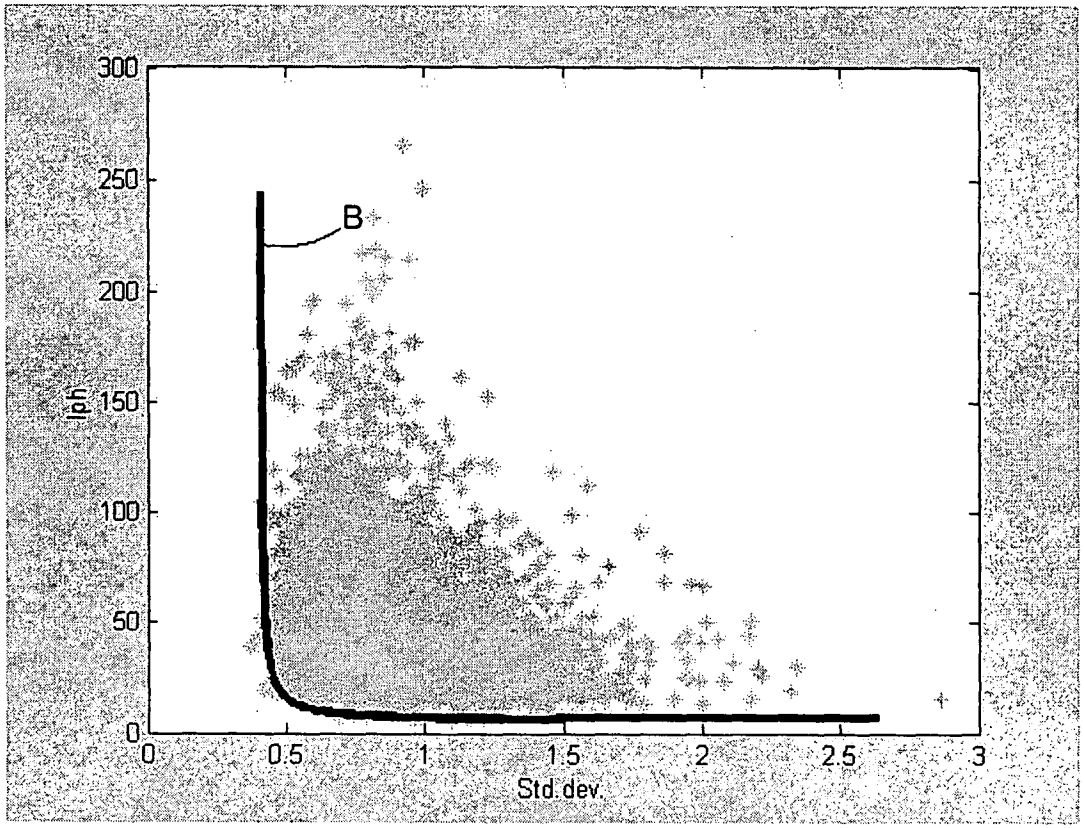
FIG. 5 shows an example of a plotting of standard deviation of energy levels in VAD filter banks as a function of the relation between low- and high-energy components in a speech signal.
Figure 6:
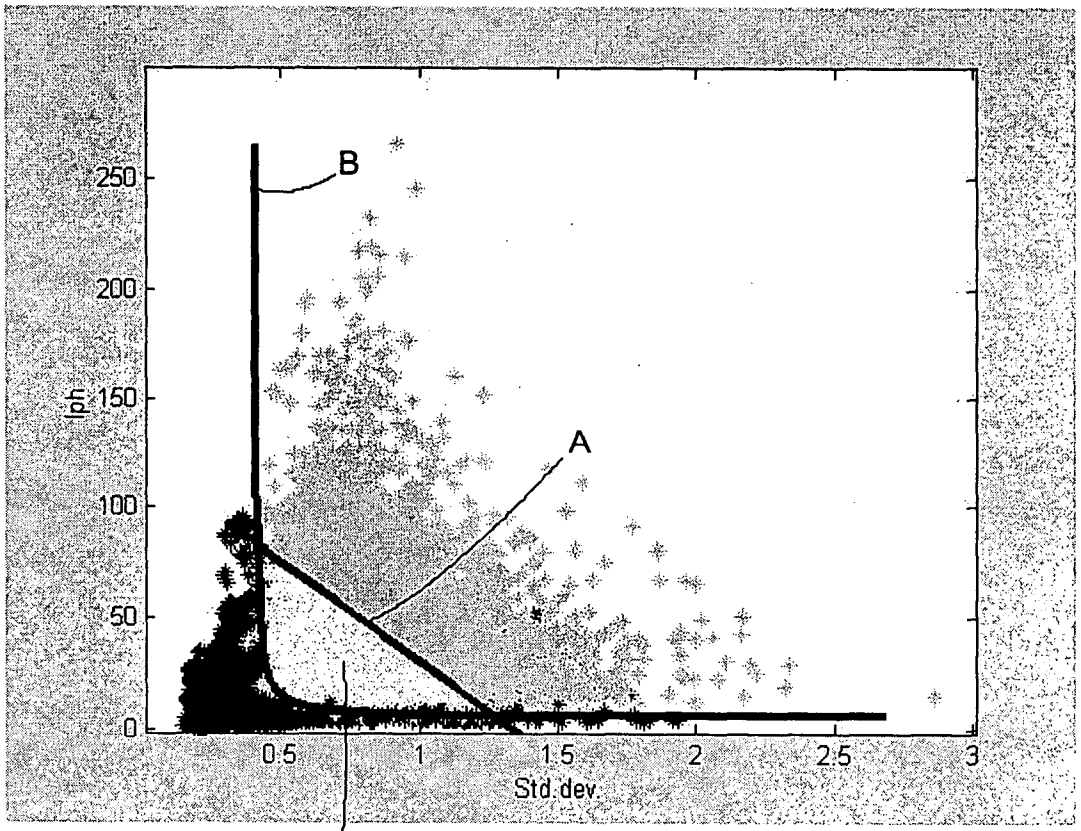
FIG. 6 shows an example of a combined plotting for both music and speech signals.

The basic idea behind the classification is illustrated in FIGS. 4, 5 and 6. FIG. 4 shows an example of a plotting of standard deviation of energy levels in VAD filter banks as a function of the relation between low and high-energy components in a music signal. Each dot corresponds to a 20 ms frame taken from the long music signal containing different variations of music. The line A is fitted to approximately correspond to the upper border of the music signal area, i.e., dots to the right side of the line are not considered as music like signals in the method according to the present invention.

Respectively, FIG. 5 shows an example of a plotting of standard deviation of energy levels in VAD filter banks as a function of the relation between low and high-energy components in a speech signal. Each dot corresponds to a 20 ms frame taken from the long speech signal containing different variations of speech and different talkers. The curve B is fitted to indicate approximately the lower border of the speech signal area, i.e., dots to the left side of the curve B are not considered as speech like in the method according to the present invention.

As can be seen in FIG. 4, most of the music signal has quite small standard deviation and relatively even frequency distribution over the analysed frequencies. For the speech signal plotted in FIG. 5, the tendency is the other way around, higher standard deviations and more low frequency components. Putting both signals into the same plot in FIG. 6 and fitting curves A, B to match the borders of the regions for both music and speech signals, it is quite easy to divide the most of the music signals and the most of the speech signals into different categories. The fitted curves A, B in the figures are the same than presented also in the attached pseudo-code above. The pictures demonstrate only a single standard deviation and low per high frequency values calculated by long windowing. The pseudo code contains an algorithm, which uses two different windowings, thus utilising two different versions of the mapping algorithm presented in FIGS. 4, 5 and 6.

The area C limited by the curves A, B in FIG. 6 indicates the overlapping area where further means for classifying music like and speech like signals may normally be needed. The area C can be made smaller by using different length of the analysis windows for the signal variation and combining these different measurements as it is done in our pseudo-code example. Some overlap can be allowed because some of the music signals can be efficiently coded with the compression optimised for speech and some speech signals can be efficiently coded with the compression optimised for music.

In the example presented above the most optimal ACELP excitation is selected by using analysis-by-synthesis and the selection between the best ACELP-excitation and TCX-excitation is done by pre-selection.

Although the invention was presented above by using two different excitation methods it is possible to use more than two different excitation methods and make the selection among them for compressing audio signals. It is also obvious that the filter 300 may divide the input signal into different frequency bands than presented above and also the number of frequency bands may be different than 12.

FIG. 7 depicts an example of a system in which the present invention can be applied. The system comprises one or more audio sources 701 producing speech and/or non-speech audio signals. The audio signals are converted into digital signals by an A/D-converter 702 when necessary. The digitised signals are input to an encoder 200 of a transmitting device 700 in which the compression is performed according to the present invention. The compressed signals are also quantised and encoded for transmission in the encoder 200 when necessary. A transmitter 703, for example a transmitter of a mobile communications device 700, transmits the compressed and encoded signals to a communication network 704. The signals are received from the communication network 704 by a receiver 705 of a receiving device 706. The received signals are transferred from the receiver 705 to a decoder 707 for decoding, dequantisation and decompression. The decoder 707 comprises detection means 708 to determine the compression method used in the encoder 200 for a current frame. The decoder 707 selects on the basis of the determination a first decompression means 709 or a second decompression means 710 for decompressing the current frame. The decompressed signals are connected from the decompression means 709, 710 to a filter 711 and a D/A converter 712 for converting the digital signal into analog signal. The analog signal can then be transformed to audio, for example, in a loudspeaker 713.

The present invention can be implemented in different kind of systems, especially in low-rate transmission for achieving more efficient compression than in prior art systems. The encoder 200 according to the present invention can be implemented in different parts of communication systems. For example, the encoder 200 can be implemented in a mobile communication device having limited processing capabilities.

It is obvious that the present invention is not solely limited to the above described embodiments but it can be modified within the scope of the appended claims.

What is claimed is:

1. An apparatus comprising:

a processor;

a memory including machine executable instructions, the memory and the machine executable instructions being configured to, in association with the processor, cause the apparatus to:

receive frames of an audio signal in a frequency band;

perform a first excitation for a speech like audio signal which is mostly speech signal; and perform a second excitation for a music like audio signal;

wherein the apparatus is further caused to:

divide the frequency band into at least a first and a second group of sub band audio signals, wherein each sub band audio signal has a narrower bandwidth than said frequency band, and said second group containing sub bands of higher frequencies than said first group;

produce information indicative of normalised signal energies of a current frame of the audio signal at least at one sub band;

select one excitation among said at least first excitation and said second excitation, the selection based on a defined relation between normalised signal energy of said first group of sub bands and normalised signal energy of said second group of sub bands for the frames of the audio signal and to use said relation in the selection of the excitation; and perform the selected excitation for a frame of the audio signal.

2. The apparatus according to claim 1, wherein the apparatus is configured to leave one or more sub bands of the available sub bands outside of said first and said second group of sub bands.

3. The apparatus according to claim 2, wherein the apparatus is configured to leave the sub band of lowest frequencies outside of said first and said second group of sub bands.

4. The apparatus according to claim 1, wherein said apparatus is embodied as an adaptive multi-rate wideband codec.

5. The apparatus according to claim 1, wherein said first excitation is Algebraic Code Excited Linear Prediction excitation and said second excitation is transform coded excitation.

6. The apparatus according to claim 1, wherein the apparatus is configured to define a first number of frames and a second number of frames, said second number being greater than said first number, wherein said apparatus is configured to calculate a first average standard deviation value using the normalised signal energies of the first number of frames including the current frame at each sub band and to calculate a second average standard deviation value using the normalised signal energies of the second number of frames including the current frame at each sub band.

7. The apparatus according to claim 1, wherein said apparatus is at least partially embodied as a filter bank of a voice activity detector.

8. A device comprising an encoder comprising an input configured to input frames of an audio signal in a frequency band, a first excitation block configured to perform a first excitation for a speech like audio signal which is mostly speech signal, and a second excitation block configured to perform a second excitation for a music like audio signal, wherein said encoder further comprises a filter configured to divide the frequency band into at least a first and a second group of sub band audio signals, wherein each sub band audio signal has a narrower bandwidth than said frequency band and said second group containing sub bands of higher frequencies than said first group wherein said filter further comprises a filter block configured to produce information indicative of normalised signal energies of a current frame of the audio signal at least at one sub band; and the device also comprising an excitation selection block configured to select one excitation block among said at least first excitation block and said second excitation block, the selection based on a defined relation between normalised signal energy of said first group of sub bands and normalised signal energy of said second group of sub bands for the frames of the audio signal and to use said relation in the selection of the excitation block so that the selected excitation block performs the excitation for a frame of the audio signal.

9. The device according to claim 8, wherein the device is configured to leave one or more sub bands of the available sub bands outside of said first and said second group of sub bands.

10. The device according to claim 9, wherein the device is configured to leave the sub band of lowest frequencies outside of said first and said second group of sub bands.

11. The device according to claim 8, wherein the device is configured to define a first number of frames and a second number of frames, said second number being greater than said first number, wherein said excitation selection block is configured to calculate a first average standard deviation value using the normalised signal energies of the first number of frames including the current frame at each sub band and to calculate a second average standard deviation value using the normalised signal energies of the second number of frames including the current frame at each sub band.

12. The device according to claim 8, wherein said filter is a filter bank of a voice activity detector.

13. The device according to claim 8, wherein said encoder is an adaptive multi-rate wideband codec.

14. The device according to claim 8, wherein said first excitation is Algebraic Code Excited Linear Prediction excitation and said second excitation is transform coded excitation.

15. The device according to claim 8, comprising a transmitter configured to transmit frames including parameters produced by the selected excitation block through a low bit rate channel.

16. A mobile communication device comprising an encoder comprising an input configured to input frames of an audio signal in a frequency band, a first excitation block configured to perform a first excitation for a speech like audio signal which is mostly speech signal, and a second excitation block configured to perform a second excitation for a music like audio signal, wherein said encoder further comprises a filter configured to divide the frequency band into at least a first and a second group of sub band audio signals, wherein each sub band audio signal has a narrower bandwidth than said frequency band and said second group containing sub bands of higher frequencies than said first group wherein said filter further comprises a filter block configured to produce information indicative of normalised signal energies of a current frame of the audio signal at least at one sub band; and the device also comprising an excitation selection block configured to select one excitation block among said at least first excitation block and a second excitation block, the selection based on a defined relation between normalised signal energy of said first group of sub bands and normalised signal energy of said second group of sub bands for the frames of the audio signal and to use said relation in the selection of the excitation block so that the selected excitation block performs the excitation for a frame of the audio signal.

17. A system comprising an encoder comprising:

a processor;

a memory including machine executable instructions, the memory and the machine executable instructions being configured to, in association with the processor, cause the encoder to:

receive frames of an audio signal in a frequency band;

perform a first excitation for a speech like audio signal which is mostly speech signal; and perform a second excitation for a music like audio signal;

wherein said encoder is further caused to:

divide the frequency band into at least a first and a second group of sub band audio signals, wherein each sub band audio signal has a narrower bandwidth than said frequency band and said second group containing sub bands of higher frequencies than said first group;

produce information indicative of normalised signal energies of a current frame of the audio signal at least at one sub band;

select one excitation among said at least first excitation and said second excitation, the selection based on a defined relation between normalised signal energy of said first group of sub bands and normalised signal energy of said second group of sub bands for the frames of the audio signal and to use said relation in the selection of the excitation; and perform the selected excitation for a frame of the audio signal.

18. The system according to claim 17, wherein the encoder is configured to leave one or more sub bands of the available sub bands outside of said first and said second group of sub bands.

19. The system according to claim 18, wherein the encoder is configured to leave the sub band of lowest frequencies outside of said first and said second group of sub bands.

20. The system according to claim 17, wherein the system is configured to define a first number of frames and a second number of frames, said second number being greater than said first number, wherein said encoder is configured to calculate a first average standard deviation value using normalised signal energies of the first number of frames including the current frame at each sub band and to calculate a second average standard deviation value using normalised signal energies of the second number of frames including the current frame at each sub band.

21. The system according to claim 17, wherein said encoder is at least partially embodied as a filter bank of a voice activity detector.

22. The system according to claim 17, wherein said encoder is embodied as an adaptive multi-rate wideband codec.

23. The system according to claim 17, wherein said first excitation is Algebraic Code Excited Linear Prediction excitation and said second excitation is transform coded excitation.

24. The system according to claim 17, wherein the encoder is an encoder of a mobile communication device.

25. The system according to claim 17, further comprising a transmitter configured to transmit frames including parameters produced by the selected excitation through a low bit rate channel.

26. A method comprising:

receiving input frames of an audio signal in a frequency band at a device;

using a first excitation for a speech like audio signal which is mostly speech signal;

using a second excitation for a music like audio signal;

dividing the frequency band into at least a first and a second group of sub band audio signals, wherein each sub band audio signal has a narrower bandwidth than said frequency band and said second group containing sub bands of higher frequencies than said first group;

producing information indicative of normalised signal energies of a current frame of the audio signal at least at one sub band by using a filter block;

selecting one excitation among said at least first excitation and said second excitation by defining a relation between normalised signal energy of said first group of sub bands and normalised signal energy of said second group of sub bands for the frames of the audio signal and using said relation in the selection of the excitation; and using the selected excitation to perform the excitation for a frame of the audio signal.

27. The method according to claim 26 comprising:

leaving one or more sub bands of the available sub bands outside of said first and said second group of sub bands.

28. The method according to claim 27 comprising:

leaving the sub band of lowest frequencies outside of said first and said second group of sub bands.

29. The method according to claim 26 comprising:

defining a first number of frames and a second number of frames, said second number being greater than said first number;

calculating a first average standard deviation value using normalised signal energies of the first number of frames including the current frame at each sub band; and calculating a second average standard deviation value using normalised signal energies of the second number of frames including the current frame at each sub band.

30. The method according to claim 26 comprising transmitting frames including parameters produced by the selected excitation through a low bit rate channel.

31. A non-transitory computer readable medium stored with instructions, which when executed by a processor, perform:

compressing audio signals in a frequency band, in which a first excitation is used for a speech like audio signal which is mostly speech signal, and a second excitation is used for a music like audio signal;

dividing the frequency band into at least a first and a second group of sub band audio signals, wherein each sub band audio signal has a narrower bandwidth than said frequency band and said second group containing sub bands of higher frequencies than said first group;

producing information indicative of normalised signal energies of a current frame of the audio signal at least at one sub band by using a filter block;

selecting one excitation among said at least first excitation and said second excitation by defining a relation between normalised signal energy of said first group of sub bands and normalised signal energy of said second group of sub bands for the frames of the audio signal and using said relation in the selection of the excitation; and using the selected excitation to perform the excitation for a frame of the audio signal.

32. The computer readable medium according to claim 31, wherein a first number of frames and a second number of frames are defined, said second number being greater than said first number, wherein the computer readable medium is further stored with instructions, which when executed by a processor, perform:

calculating a first average standard deviation value using normalised signal energies of the first number of frames including the current frame at each sub band; and calculating a second average standard deviation value using normalised signal energies of the second number of frames including the current frame at each sub band.

33. The computer readable medium according to claim 31 further stored with instructions, which when executed by a processor, perform:

Algebraic Code Excited Linear Prediction excitation as said first excitation; and transform coded excitation as said second excitation.

* * * * *